US011629620B1

(12) United States Patent
Fluharty et al.

(10) Patent No.: US 11,629,620 B1
(45) Date of Patent: Apr. 18, 2023

(54) CYLINDER HEAD AND FLOW RESTRICTOR PLUG FOR A CYLINDER HEAD

(71) Applicant: FORD GLOBAL TECHNOLOGIES, LLC, Dearborn, MI (US)

(72) Inventors: Jeffrey D. Fluharty, Woodhaven, MI (US); Forest Heggie, LaSalle (CA); Daniel Nelson, Macomb, MI (US); Jonathan Denis Crowe, Northville, MI (US); David Henderlong, South Lyon, MI (US); Richard J. Anton, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/736,497

(22) Filed: May 4, 2022

(51) Int. Cl.
*F01M 1/16* (2006.01)
*F02F 11/00* (2006.01)
*F01M 11/04* (2006.01)

(52) U.S. Cl.
CPC ..... *F01M 1/16* (2013.01); *F02F 11/002* (2013.01); *F01M 2011/0416* (2013.01)

(58) Field of Classification Search
CPC ... F01M 1/16; F01M 2011/0416; F02F 11/00; F02F 11/002; F01P 2003/003; F01P 2011/0228
See application file for complete search history.

(56) References Cited

U.S. PATENT DOCUMENTS

| | | | |
|---|---|---|---|
| 5,771,853 | A | 6/1998 | Kuo |
| 5,937,495 | A | 8/1999 | Kuo |
| 10,465,571 | B2 | 11/2019 | Fluharty et al. |
| 11,066,965 | B1 | 7/2021 | Heggie et al. |
| 2013/0160728 | A1 | 7/2013 | Hara et al. |
| 2016/0341103 | A1* | 11/2016 | Ponter ..... F01P 11/028 |
| 2019/0186412 | A1 | 6/2019 | Cultraro |

FOREIGN PATENT DOCUMENTS

| | | | |
|---|---|---|---|
| KR | 20050123465 | A | 12/2005 |
| KR | 20070110571 | A | 11/2007 |

* cited by examiner

*Primary Examiner* — Jacob M Amick
(74) *Attorney, Agent, or Firm* — Vincent Mastrogiacomo; Brooks Kushman.P.C.

(57) ABSTRACT

A cylinder head for an internal combustion engine includes a casting and plug. The casting defines a first channel, a second channel, and a bore extending inward from an exterior surface of the casting. The first channel intersects a central portion of the bore. The second channel intersects an opposing end of the bore relative to the exterior surface. The plug is disposed within the bore. The plug has a distal end that engages the casting along the opposing end of the bore via a slip-fit engagement, a proximal end that engages the casting within the bore proximal to the exterior surface via a fixed engagement, and an intermediate portion that is spaced apart from the casting along the central portion of the bore. The plug defines an internal channel that establishes fluid communication between the first and second channels.

19 Claims, 3 Drawing Sheets

CYLINDER HEAD AND FLOW RESTRICTOR PLUG FOR A CYLINDER HEAD

TECHNICAL FIELD

The present disclosure relates to internal combustion engines and more specifically to cylinder heads for internal combustion engines.

BACKGROUND

Internal combustion engines include cylinder heads. The cylinder heads may define channels, chambers, and other internal spaces that are configured to route lubricating fluid to various components within the cylinder head.

SUMMARY

A cylinder head for an internal combustion engine includes a casting and plug. The casting defines a first fluid circuit, a second fluid circuit, and a chamber. The first fluid circuit is configured to operate at an increased fluid pressure relative to the second fluid circuit. The first fluid circuit intersects a central portion of the chamber. The second fluid circuit intersects a first end of the chamber. The second end of the chamber defines an opening along an exterior surface of the casting. The plug is disposed within the chamber. The plug has a distal end that engages the casting along the first end of the chamber via a slip-fit engagement, a proximal end that engages the casting along the second end of the chamber via threaded engagement, and an intermediate portion that is spaced apart from the casting along the central portion of the chamber. The plug defines an internal channel that establishes fluid communication between the first and second fluid circuits. The plug also defines a restrictor orifice that limits a fluid flow rate through the internal channel.

A cylinder head for an internal combustion engine includes a casting and plug. The casting defines a first channel, a second channel, and a bore extending inward from an exterior surface of the casting. The first channel intersects a central portion of the bore. The second channel intersects an opposing end of the bore relative to the exterior surface. The plug is disposed within the bore. The plug has a distal end that engages the casting along the opposing end of the bore via a slip-fit engagement, a proximal end that engages the casting within the bore proximal to the exterior surface via a fixed engagement, and an intermediate portion that is spaced apart from the casting along the central portion of the bore. The plug defines an internal channel that establishes fluid communication between the first and second channels. The internal channel also limits a fluid flow rate from the first channel to the second channel.

A flow restrictor plug includes a distal end, a proximal end, and an intermediate portion. The distal end is configured to engage a cylinder head casting via a slip-fit engagement. The proximal end has a threaded portion configured to engage the casting in fixed arrangement. The intermediate portion is disposed between the distal and proximal ends. The plug defines an internal channel extending axially from the intermediate portion to the distal end. The plug also defines a restrictor orifice extending radially inward from the intermediate portion. The restrictor orifice intersects and limits a fluid flow rate through the internal channel.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
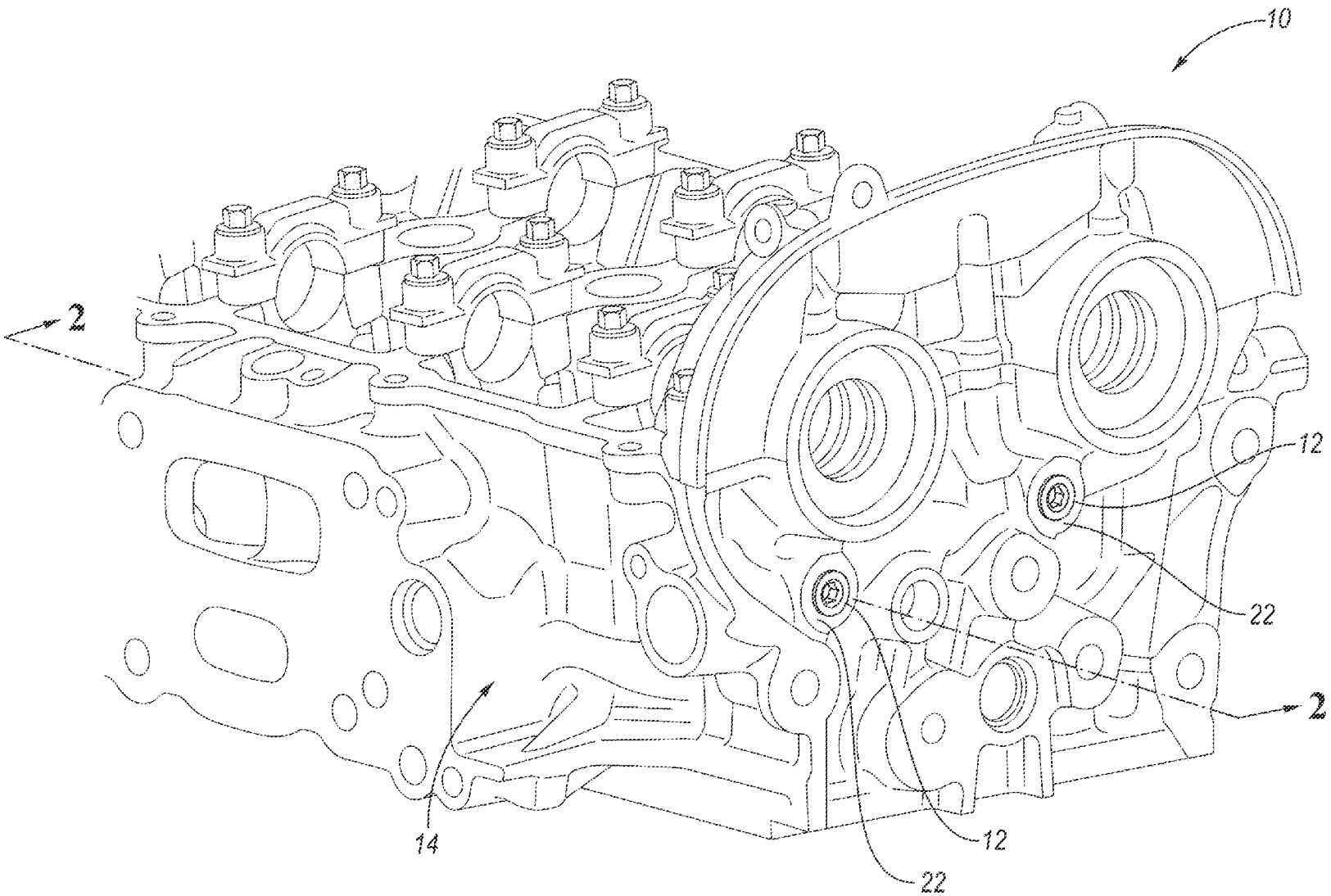
FIG. 1 is an isometric view of a cylinder head of an internal combustion engine.

Referring to FIG. 1, a cylinder head 10 for an internal combustion engine and restrictor plugs 12 for the cylinder are illustrated. The cylinder head 10 defines combustion chambers or a portion of the combustion chambers of the engine. Intake ports, conduits, or channels are defined within the cylinder head 10. The intake channels are configured to channel or deliver air to the cylinders defined by an engine block (not shown). The air is mixed with fuel so that the oxygen within the air and the fuel may be combusted via a spark plug (not show). The fuel may be delivered to the cylinders along with the air in the intake channels or may be delivered to the cylinders separately via fuel injectors (not shown). Air intake valves (not shown) may be disposed within intake channels adjacent to the combustion chambers. The air intake valves associated with each cylinder may be configured to open during an intake stroke of a piston of the associated cylinder and to close during compression, power, and exhaust strokes of the piston of the associated cylinder.

Exhaust ports, conduits, or channels are defined within the cylinder head 10. The exhaust channels are configured to channel or direct exhaust gas away from the cylinders of the engine. Exhaust valves (not shown) may be disposed within exhaust channels adjacent to the combustion chambers. The exhaust valves associated with each cylinder may be configured to open during an exhaust stroke of the piston of the associated cylinder and to close during intake, compression, and power strokes of the piston of the associated cylinder.

The cylinder head 10 may further define cavities, conduits, chambers, or channels that are configured to channel or direct fluid or oil through the cylinder head 10 for the purpose of cooling the cylinder head 10, lubricating moving components with the cylinder, or for actuating hydraulically operated components. The fluid or oil may more specifically be directed toward valves, cam shafts, and other moving parts within the cylinder head for lubricating purposes. The cylinder head 10 may include a variable cam timing system that directs fluid into and out of phaser cavities to change the valve timing by rotating the camshaft slightly from a base orientation, which results in the camshaft timing either being advanced or retarded. The cylinder head 10 may include hydraulic lash adjusters that are configured to adjust the lash between the valves (e.g., the air intake valves or exhaust valves) and associated rocker arms or cam followers.

The fluid circuits, conduits, chambers, or channels associated with the variable cam timing system may be operated at a higher fluid pressure relative to the fluid circuits, conduits, chambers, or channels associated with the hydraulic lash adjusters or lubrication of moving parts. The restrictor plugs 12 may include channels or orifices that connect the higher-pressure fluid circuits, conduits, chambers, or channels associated with the variable cam timing system to the lower-pressure fluid circuits, conduits, chambers, or channels associated with hydraulic lash adjusters or lubrication of moving parts. The restrictor plugs 12 are configured to decrease the pressure of the fluid as the fluid flows through the channels or orifices of restrictor plugs 12 from the higher-pressure fluid circuits, conduits, chambers, or channels to the lower-pressure fluid circuits, conduits, chambers, or channels.

Using press-fit restrictor plugs in cast aluminum cylinder heads may result in small leaks around the pressed sealing of the plugs. This may not be a significant issue if the plugs are positioned behind a front cover of the engine. However, it is undesirable for the plugs to leak in dry front cylinder head designs where the cylinder heads are not placed behind a font cover of the engine. In addition, the restrictor plugs require the ability to be serviced if there is a leak. Pressed in restrictor plugs may be removed from a cylinder head by being hammered out with tools. However, this may leave the cylinder head altered with scratches at the sealing press surfaces for the plugs. After a new plug is installed, such alterations or scratches have the tendency to allow the new plug to leak after installation.

The restrictor plug 12 described herein allows for a reliable and reusable plug seal and eliminates the leaking potential that is associated with press-fit restrictor plugs. The restrictor plug 12 includes an O-ring and is secured to the cylinder head 10 via a threaded engagement, eliminating the need to press-fit the restrictor plug into the cylinder head 10. Additionally, the tip of the restrictor plug 12 is modified to perform the oil restriction for the lash adjuster oil gallery or chamber. The unique combination of the oil restrictor having a drill hole restriction and a slip-fit restriction design improves the oil restriction robustness especially for hot engine oil scenarios. Service of the threaded restrictor plug 12 is also improved relative to a press-fit restrictor plug by eliminating the need for a special tool to hammer the restrictor plug out of the cylinder head, which eliminates any undesirable alterations or scratches that may occur to the cylinder head.

Figure 2:
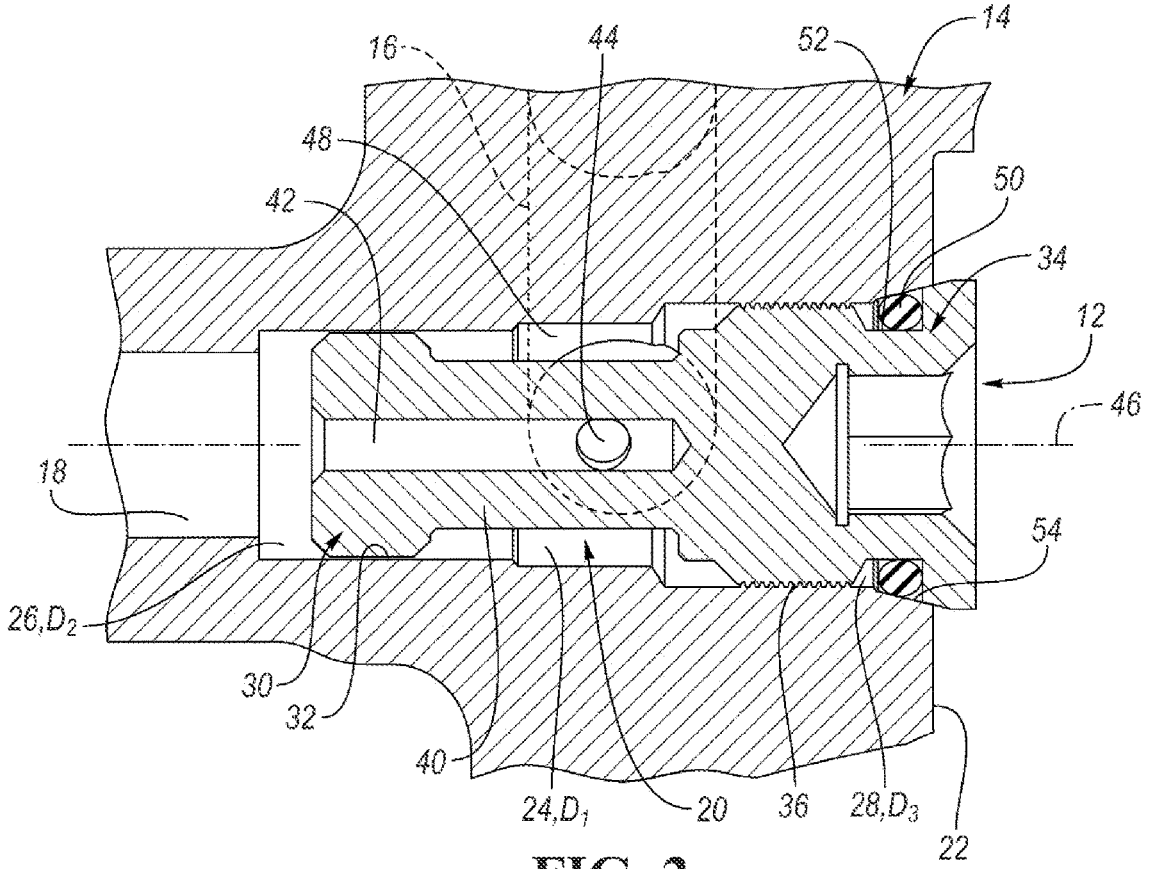
FIG. 2 is a partial cross-sectional view taken along line 2-2 in FIG. 1.
Figure 3:
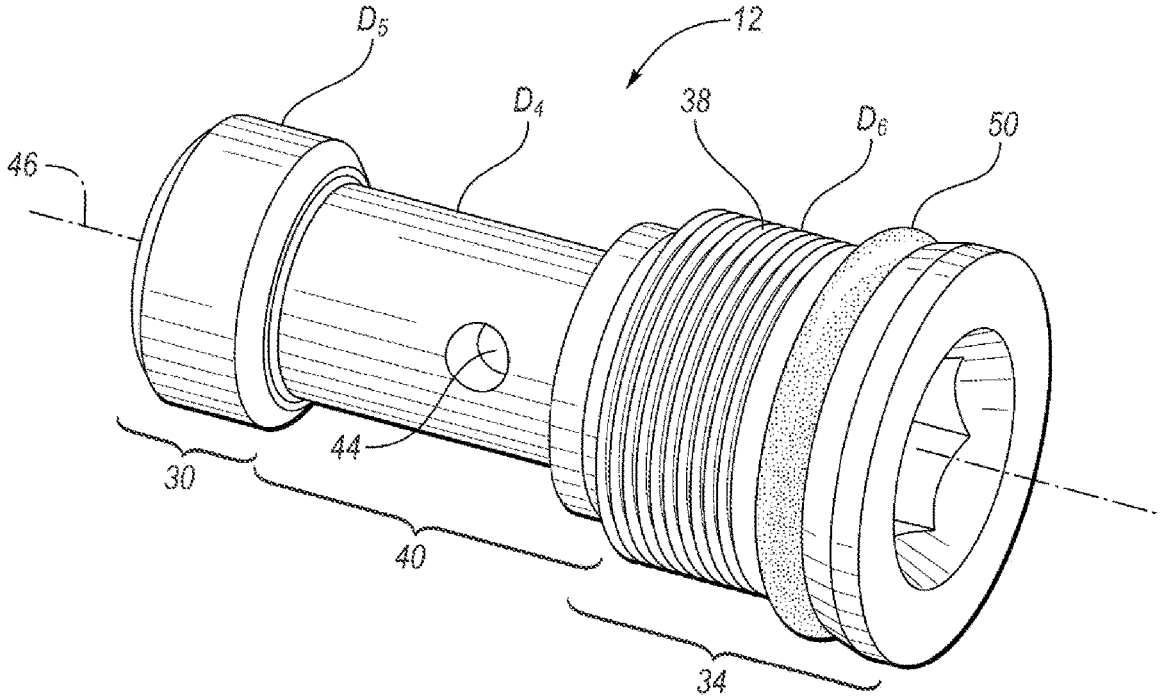
FIG. 3 is an isometric view of a restrictor plug for the cylinder head.

Referring to FIGS. 2 and 3, the restrictor plug 12 and the interaction between the restrictor plug 12 and the cylinder head 10 are illustrated in further detail. The cylinder head 10 includes a main body or casting 14. The casting 14 defines a first fluid circuit or channel 16 and a second fluid circuit or channel 18. The casting 14 further defines a bore or chamber 20 that connects the first fluid channel 16 to the second fluid channel 18. The chamber 20 may extend inward from an exterior surface 22 of the casting 14. The first fluid channel 16 is configured to operate at an increased fluid pressure relative to the second fluid channel 18. For example, the first fluid channel 16 may be configured to provide fluid to a variable cam timing system while the second fluid channel 18 may be configured to provide fluid to hydraulic lash adjusters or for lubrication of moving parts within the cylinder head 10.

The first fluid channel 16 intersects a central portion 24 of the chamber 20. The second fluid channel 18 intersects a first end 26 of the chamber 20. A second end 28 of the chamber 20 defines an opening into the chamber 20 along the exterior surface 22 of the casting 14. The first end 26 of the chamber 20 may be referred to as the opposing end of the bore or chamber 20 relative to the exterior surface 22 of the casting 14 or relative to an end of the bore or chamber 20 that is adjacent to the exterior surface 22 of the casting 14. The second end 28 of the chamber 20 may be referred to as the portion of the bore or chamber 20 that is proximal or adjacent to the exterior surface 22 of the casting 14. A diameter, $D_1$, of central portion 24 of the chamber 20 may be greater than a diameter, $D_2$, of the first end 26 of the chamber 20. A diameter, $D_3$, of the second end 28 of the chamber 20 may be greater than both the diameter, $D_1$, of central portion 24 of the chamber 20 and the diameter, $D_2$, of first end 26 of the chamber 20.

The restrictor plug 12 is disposed with the chamber 20. The restrictor plug 12 has a distal end 30 that engages the casting 14 along the first end 26 of the chamber via a slip-fit engagement 32. The restrictor plug 12 has a proximal end 34 that engages the casting 14 along the second end 28 of the chamber 20 via a fixed engagement or fixed arrangement. The fixed engagement or fixed arrangement maybe a threaded engagement 36. More specifically, the second end 28 of the chamber 20 or a portion of the second end 28 of the chamber 20 may be a tapped orifice and a portion of the proximal end 34 of the restrictor plug 12 may have threading 38 that is configured to engage the tapped orifice to secure the restrictor plug 12 to the casting 14.

The restrictor plug 12 includes an intermediate portion 40 that is spaced apart from the casting 14 along the central portion 24 of the chamber 20. The intermediate portion 40 is disposed between the distal end 30 and the proximal end 34. An outer diameter, $D_4$, of the intermediate portion 40 may be less than an outer diameter, $D_5$, of the distal end 30 and an outer diameter, $D_6$, of the proximal end 34. The outer diameter, $D_5$, of the distal end 30 may be less than the outer diameter, $D_6$, of the proximal end 34. It is noted that the outer diameter, $D_6$, of the proximal end 34 may be variable along different positions of the proximal end 34. For example, the outer diameter of the proximal end 34 may be greater along the portion of the proximal end 34 that is at the very end of the restrictor plug 12 relative to the portion of the proximal end 34 that includes the threading 38. The restrictor plug 12 defines an internal channel 42 that establishes fluid communication between the first fluid channel 16 and the second fluid channel 18. The internal channel 42 also limits or restricts a fluid flow rate from the first fluid channel 16 to the second fluid channel 18. More specifically, the restrictor plug 12 may define a restrictor orifice 44 that limits or restricts a fluid flow rate through the internal channel in order to limit or restrict the fluid flow rate from the first fluid channel 16 to the second fluid channel 18.

The internal channel 42 may extending axially (e.g., along a central axis 46 or an axis about which the restrictor plug 12 is rotated during installation) from the intermediate portion 40, to the distal end 30, and through the tip of the restrictor plug 12 along the distal end 30. The internal channel 42 may be centrally located within the restrictor plug 12 and may be positioned directly on the central axis 46. The restrictor orifice 44 extends radially inward from the intermediate portion 40 of the restrictor plug 12 and may terminate at a position where the restrictor orifice 44 intersects the internal channel 42. The restrictor orifice 44 may be substantially perpendicular to the internal channel 42. Substantially perpendicular may refer to any incremental angle that is between exactly perpendicular and 15° from exactly perpendicular.

The central portion 24 of the chamber 20 may form an annular channel 48 that extends about the intermediate portion 40 of the restrictor plug 12. The annular channel 48 is in direct fluid communication with the first fluid channel 16 and is in fluid communication with the second fluid channel 18 via the internal channel 42 and the restrictor orifice 44. The annular channel 48 may also include portions of the first end 26 and second end 28 of the chamber 20.

The slip-fit engagement 32 between the distal end 30 of the restrictor plug 12 and the casting 14 along the first end 26 of the chamber 20 establishes a supplementary restricted fluid communication between the annular channel 48 and the second fluid channel 18. More specifically, the small gap resulting from the slip-fit engagement 32 between the distal end 30 of the restrictor plug 12 and the casting 14 along the first end 26 of the chamber 20 acts as a second restrictor orifice that allows fluid to flow therethrough from the annular channel 48 to the second fluid channel 18. The gap resulting from the slip-fit engagement 32 may be annular in shape. The gap resulting from the slip-fit engagement 32 allows but limits the flow of fluid therethrough from the annular channel 48 to the second fluid channel 18. The gap resulting from the slip-fit engagement 32 also reduces the pressure of the fluid as the fluid flows therethrough from the annular channel 48 to the second fluid channel 18. The fluid flow rate though the slip-fit engagement 32 and the restrictor orifice 44, however, may increase as the temperature of the fluid increases and may decrease as the temperature of the fluid decreases.

The restrictor plug 12 may include an O-ring seal 50 that is disposed about a portion of the proximal end 34 of the restrictor plug 12. The O-ring seal 50 engages the casting 14 along the second end 28 of the chamber 20 and exterior to the threaded engagement 36. The O-ring seal 50 may be compressed to provide the seal between the restrictor plug 12 and casting 14 to prevent oil or fluid from leaking between the restrictor plug 12 and the casting 14 along the exterior surface 22 of the casting 14. The restrictor plug 12 may define a groove 52 along the distal end 34. The O-ring seal 50 may be positioned with the groove 52. The groove 52 may be positioned axially outward from the threaded portion. The casting 14 may define a fillet 54 extending from the second end 28 of the chamber 20 to the exterior surface 22 of the casting 14. The O-ring may engage the casting 14 along the fillet 54.

The fluid or oil metering function of the restrictor plug 12 through the slip-fit engagement 32 and the restrictor orifice 44, and while the fluid or oil is warm or hot (i.e., is at or near operating temperature), provides moderate resistance to oil flow to the lash adjuster galleries or chambers to maintain adequate oil pressure levels for valvetrain system function (i.e., the operation of the air intake and exhaust valves of the cylinder head 10). This provides for general lubrication to the cam journals and cam lobes, allows for adequate oil re-fill to a valve lash adjuster galleries or chambers following a lift event, and avoids excessive flow, which can reduce lower end oil pressure and increase resident time of oil in the head cavity (which may cause aeration due to increased splash oil and reduced oil volume in the oil pan of the engine).

The fluid or oil metering function of the restrictor plug 12 through the slip-fit engagement 32 and the restrictor orifice 44, and while the fluid or oil is cold (i.e., is below operating temperature), provides a high resistance to oil flow to the lash adjuster chambers so that lash adjuster chambers are not over-pressurized. Over-pressurization may increase system sensitivity to lash adjuster pump up, which could result in the valves not fully closing.

Figure 4:
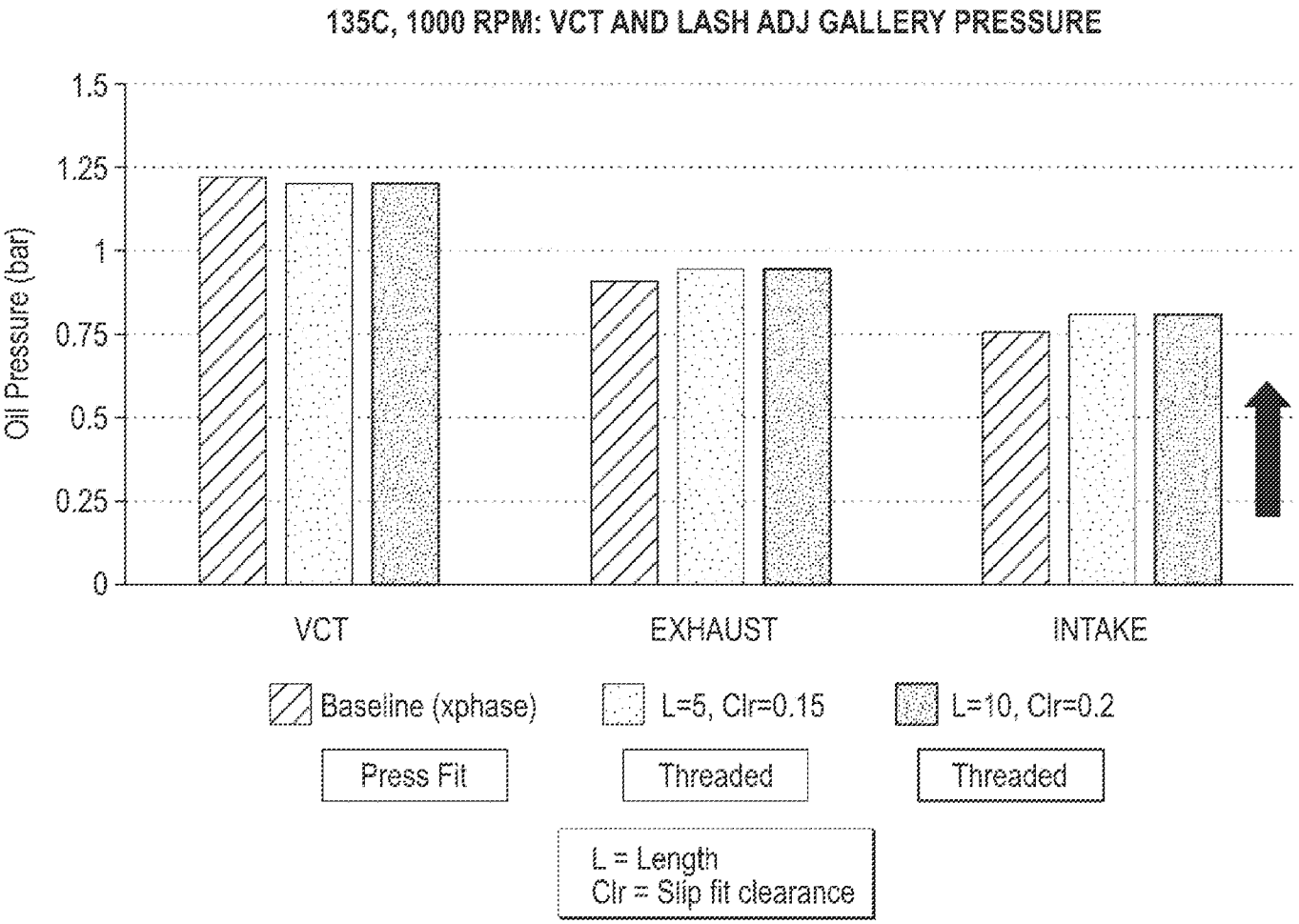
FIG. 4 is a series of graphs illustrating fluid flow through the cylinder head utilizing various restrictor plug designs.

Referring to FIG. 4, a series of bar graphs of the fluid flow through the cylinder head utilizing various restrictor plug designs are illustrated. The bars labelled "press fit" refer to the performance of fluid flow at various places in the cylinder head 10 using a press-fit restrictor plug. The bars labelled "threaded" refer to the performance of fluid flow at various places in the cylinder head 10 using a threaded and slip-fit restrictor plug (e.g., restrictor plug 12). The clearances (e.g., the gap resulting from the slip-fit engagement 32) between the distal ends (e.g., distal end 30) of the restrictor plugs and the first ends of the chambers (e.g., first ends 26) are listed for two variations of restrictor plugs. The length of engagement of the distal ends (e.g., distal end 30) of the restrictor plugs and the first ends of the chambers (e.g., first ends 26) along central axes (central axis 46) are also listed for the two the variations of restrictor plugs.

The first set of bars illustrates the pressure of the fluid or oil being fed to a variable cam timing system, the second set of bars illustrates the pressure of the fluid or oil being fed to the valve lash adjusters for the exhaust valves, and the third set of bars illustrates the pressure of the fluid or oil being fed to the valve lash adjusters for the air intake valves. The data illustrates that utilizing a threaded and slip-fit restrictor plug (e.g., restrictor plug 12) as opposed to a press-fit restrictor plug allows for an increase in the pressure of the fluid or oil being delivered to the valve lash adjusters for both the exhaust valves and air intake valves, which is desirable, while only a negligible decrease is experienced in the fluid or oil pressure of the fluid being fed to a variable cam timing system.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A cylinder head for an internal combustion engine comprising:

a casting defining a first fluid circuit, a second fluid circuit, and a chamber, wherein (i) the first fluid circuit is configured to operate at an increased fluid pressure relative to the second fluid circuit, (ii) the first fluid circuit intersects a central portion of the chamber, (iii) the second fluid circuit intersects a first end of the chamber, and (iv) a second end of the chamber defines an opening along an exterior surface of the casting; and a plug disposed within the chamber, the plug having (i) a distal end that engages the casting along the first end of the chamber via a slip-fit engagement, (ii) a proximal end that engages the casting along the second end of the chamber via a threaded engagement, and (iii) an intermediate portion that is spaced apart from the casting along the central portion of the chamber, and wherein the plug defines (i) an internal channel that establishes fluid communication between the first and second fluid circuits and (ii) a restrictor orifice that limits a fluid flow rate through the internal channel.

2. The cylinder head of claim 1, wherein the central portion of the chamber forms an annular channel that extends about the intermediate portion, wherein the annular channel is (i) in direct fluid communication with the first fluid circuit and (ii) in fluid communication with the second fluid circuit via the internal channel and the restrictor orifice.

3. The cylinder head of claim 2, wherein the slip-fit engagement establishes supplementary restricted fluid communication between the annular channel and the second fluid circuit.

4. The cylinder head of claim 2, wherein a fluid flow rate from the annular channel through the restrictor orifice increases as a fluid temperature increases.

5. The cylinder head of claim 1, wherein a diameter of the central portion of the chamber is greater than a diameter of the first end of the chamber.

6. The cylinder head of claim 5, wherein a diameter of the second end of the chamber is greater than the diameter of the central portion of the chamber.

7. The cylinder head of claim 1, wherein the restrictor orifice is substantially perpendicular to the internal channel.

8. The cylinder head of claim 1, wherein the plug includes an O-ring seal that is disposed about the proximal end and engages the casting along the second end of the chamber and exterior to the threaded engagement.

9. The cylinder head of claim 8, wherein the casting defines a fillet extending from the second end of the chamber to the exterior surface of the casting, and wherein the O-ring engages the fillet.

10. A cylinder head for an internal combustion engine comprising:

a casting defining a first channel, a second channel, and a bore extending inward from an exterior surface of the casting, wherein (i) the first channel intersects a central portion of the bore and (ii) the second channel intersects an opposing end of the bore relative to the exterior surface; and a plug disposed within the bore, the plug having (i) a distal end that engages the casting along the opposing end of the bore via a slip-fit engagement, (ii) a proximal end that engages the casting within the bore proximal to the exterior surface via a fixed engagement, and (iii) an intermediate portion that is spaced apart from the casting along the central portion of the bore, wherein the plug defines an internal channel that (i) establishes fluid communication between the first and second channels and (ii) limits a fluid flow rate from the first channel to the second channel.

11. The cylinder head of claim 10, wherein the fixed engagement is a threaded engagement.

12. The cylinder head of claim 10, wherein the central portion of the bore forms an annular channel that extends about the intermediate portion, wherein the annular channel is (i) in direct fluid communication with the first channel and (ii) in fluid communication with the second channel via the internal channel.

13. The cylinder head of claim 12, wherein the slip-fit engagement establishes supplementary restricted fluid communication between the annular channel and the second channel.

14. The cylinder head of claim 12, wherein a fluid flow rate from the annular channel through the internal channel increases as a fluid temperature increases.

15. The cylinder head of claim 10, wherein a diameter of the central portion of the bore is greater than a diameter of the opposing end of the bore.

16. The cylinder head of claim 15, wherein a diameter of a portion of the bore that is proximal to the exterior surface is greater than the diameter of the central portion of the bore.

17. The cylinder head of claim 10, wherein the plug includes an O-ring seal that is disposed about the proximal end and engages the casting within the bore proximal to the exterior surface and exterior to the fixed engagement.

18. A flow restrictor plug comprising:

a distal end configured to engage a cylinder head casting via a slip-fit engagement;

a proximal end (i) having a threaded portion configured to engage the casting in fixed arrangement and (ii) defining a groove configured to receive an O-ring, wherein the groove is positioned axially outward from the threaded portion; and an intermediate portion that is disposed between the distal and proximal ends, wherein the plug defines (i) an internal channel extending axially from the intermediate portion to the distal end and (ii) a restrictor orifice extending radially inward from the intermediate portion, and wherein the restrictor orifice intersects and limits a fluid flow rate through the internal channel.

19. The flow restrictor plug of claim 18, wherein an outer diameter of the intermediate portion is less than outer diameters of the distal and proximal ends.

* * * * *